US011725896B2

(12) United States Patent
Jansson

(10) Patent No.: US 11,725,896 B2
(45) Date of Patent: Aug. 15, 2023

(54) REPEATABLE PLASMA GENERATOR

(71) Applicant: BAE SYSTEMS BOFORS AB, Karlskoga (SE)

(72) Inventor: Mats Jansson, Vintrosa (SE)

(73) Assignee: BAE SYSTEMS BOFORS AB, Karlskoga (SE)

( * ) Notice: Subject to any disclaimer, the term of this patent is extended or adjusted under 35 U.S.C. 154(b) by 0 days.

(21) Appl. No.: 17/781,817

(22) PCT Filed: Dec. 1, 2020

(86) PCT No.: PCT/SE2020/051150
§ 371 (c)(1),
(2) Date: Jun. 2, 2022

(87) PCT Pub. No.: WO2021/126039
PCT Pub. Date: Jun. 24, 2021

(65) Prior Publication Data

US 2023/0003477 A1 Jan. 5, 2023

(30) Foreign Application Priority Data

Dec. 20, 2019 (SE) ..... 1930411-2

(51) Int. Cl.
*F41A 19/63* (2006.01)
*F42C 19/08* (2006.01)

(52) U.S. Cl.
CPC ..... *F41A 19/63* (2013.01); *F42C 19/0811* (2013.01); *F42C 19/0823* (2013.01)

(58) Field of Classification Search
CPC ..... F42B 3/12; F42B 3/06; F42B 3/11; F42B 5/08; F42C 19/12; F42C 19/0823; F42C 19/0811; F42C 19/63
USPC ..... 42/84
See application file for complete search history.

(56) References Cited

U.S. PATENT DOCUMENTS 4,913,029 A * 4/1990 Tidman ..... F41B 6/00 318/135
5,072,647 A * 12/1991 Goldstein ..... F42C 19/0811 102/440
5,231,242 A 7/1993 Chryssomallis et al.
6,237,494 B1 * 5/2001 Brunet ..... F41A 19/58 102/202.7
6,703,580 B2 3/2004 Brunet et al.
(Continued)

FOREIGN PATENT DOCUMENTS

DE 4028411 A1 3/1992
DE 10335890 A1 3/2005

OTHER PUBLICATIONS

International Search Report (dated Feb. 1, 2021) for corresponding International App. PCT/SE2020/051150.

*Primary Examiner* — John Cooper
(74) *Attorney, Agent, or Firm* — WRB-IP PLLC

(57) ABSTRACT

A plasma generator is provided for initiation of propellant charges in a weapons system, for example when launching projectiles from a barrel weapon, by electrical discharge between a rear electrode and a front electrode in a combustion chamber channel enclosed in a combustion chamber body and filled with filling gas, designed to ignite at least one propellant charge. An ammunition unit and a launching device including the plasma generator are also provided.

10 Claims, 4 Drawing Sheets

(56) References Cited

U.S. PATENT DOCUMENTS

| | | | | |
|---|---|---|---|---|
| 7,059,249 | B2 * | 6/2006 | Chaboki | F42C 19/0811 102/202.7 |
| 7,073,447 | B2 * | 7/2006 | Triviski | F41A 19/69 89/8 |
| 7,581,499 | B2 * | 9/2009 | Stark | F42B 5/297 102/472 |
| 2007/0120495 | A1 | 5/2007 | Jung et al. | |
| 2011/0050076 | A1 | 3/2011 | Gustavsson et al. | |
| 2014/0083317 | A1 * | 3/2014 | Aberg | F42B 3/14 102/202 |
| 2014/0352564 | A1 * | 12/2014 | berg | F42C 19/12 102/202.8 |

* cited by examiner

REPEATABLE PLASMA GENERATOR

BACKGROUND AND SUMMARY

The present invention relates to an improved plasma generator for repeatable initiation of propellant charges in a weapons system, for example when launching projectiles from a barrel weapon, through electrical discharge in a combustion chamber layout comprising a combustion chamber channel and a combustion chamber body arranged in connection with a propellant charge. The invention also relates to an ammunition unit comprising a repeatable plasma generator for initiation of propellant charges when launching projectiles from a barrel weapon and a launching device comprising a repeatable plasma generator.

A conventional barrel weapon means here a weapon of the type of an artillery piece, a naval piece, or a tank piece or other piece containing a barrel in which a projectile is fired and propelled through the barrel by a propellant charge which is ignited by means of a pyrotechnical igniter, such as a spark plug, an ignition cartridge, etc. The propellant charge, also called the propellant, refers here to a powder of solid form, which gives off gases during its burning, driving the projectile forward to the mouth of the barrel under high pressure in the barrel. The propellant can also be a type other than a solid powder.

High gas pressure for a long time means a high muzzle velocity of the projectile when the projectile leaves the barrel. The high muzzle velocity of the projectile is utilized, for example, to increase the range of the weapon, to improve the projectile's penetrating power or reduce the time course of the projectile's trajectory.

A pressure curve for an optimal combustion process, and thus high launch speed, should show an almost immediate pressure increase to $P_{max}$, then a long-lasting plateau phase with a maintained constant barrel pressure at $P_{max}$ for the entire time that the propellant charge is burning inside the barrel, and then dropping immediately to zero when the projectile leaves the barrel. All of the propellant charge should have normally been burned at this time.

Regardless of the choice of propellant charge, the ignition process is of great importance to the pressure course and therefore the igniter and ignition system are critical to achieving high launch speed.

While at the same time the highest possible launch speed is desired, there is a need to reduce the vulnerability of the propellant. A propellant of this type is known as LOVA (LOw VulnerAbility). The low-vulnerability propellant is hard to ignite, which lessens the risk of accidental initiation of propellant in risky situations, for example, when a combat vehicle is being fired upon by enemy fire. The decreased vulnerability also means increased requirements for the igniters. The igniters must then generate an increased amount of energy and/or increased pressure in order to create the ignition process. The igniters normally consist of an easily initiated explosive, and if the quantity of the explosive is increased, this stands in direct opposition to adopting a propellant of LOVA type. Basically, ignition occurs through an ignition chain, where a very small quantity of sensitive explosive, known as the primary set, such as lead azide or silver azide, is ignited by mechanical shock or electrical pulse. The primary set then ignites the secondary set of the igniter, usually black powder, which in turn initiates the propellant. By replacing the pyrotechnical igniter or the entire ignition chain with a plasma igniter, the vulnerability of the system to unintentional initiation is decreased. At the same time, an increased dynamism is made possible for generating the more powerful ignition pulses needed to ignite the low-vulnerability (LOVA) propellant.

Conventional igniters also have a logistical and technical problem. For barrel weapons using propellant charges separated from the projectiles, such as artillery and heavy ship cannons, a separate ignition cartridge is often used for initiation of the propellant charge. An ignition cartridge is used for each firing. Thus, a mechanical system mounted on the cannon is needed for storing, loading, and removing of the ignition cartridge. By using a plasma igniter, the logistical problems of ignition cartridges are avoided. A commonly occurring problem is that the ignition cartridge gets stuck in the cartridge position. Ignition cartridges expand when the weapons system is fired, so that the ignition cartridge gets wedged in the cartridge position and firearm malfunction occurs. By adopting a plasma igniter, firearm malfunction is avoided and the functional safety is increased.

Plasma igniters for initiation of propellant charges have been described, for example, in U.S. Pat. Nos. 5,231,242 (A) and 6,703,580 (B2). The plasma igniters are built on the principle of exploding wires, that is, an electrically conductive wire which is heated, gasified, and partly ionized by an electric current. The drawback is that the wire is consumed and needs to be replaced with a new one before each firing. Thus, the plasma igniter is a onetime type.

Repeatable plasma igniters are known, for example in patent documents DE-103 35 890 (A1) and DE-40 28 411 (A1). The plasma igniters are built on the principle of spraying an electrically conductive liquid between two electrodes with an electrical potential difference, whereupon the electrical circuit is short-circuited and generates a discharge and a plasma generation. The use of liquids means complicated devices for dispensing and supplying, and also problems with possibly toxic, high-energy or easily ignitable substances. The use of liquids also requires a complicated logistics for handling of liquids.

Swedish patent application SE 1001194-8 shows a plasma igniter with ionization electrodes for ionization of a combustion chamber body, where the ionization makes possible an electrical flashover between two electrodes. The proposed plasma igniter is only partially adjustable for different lengths of the plasma igniter and different ignition energies.

Swedish patent application SE 1130128-0 shows a plasma igniter where filling gas in a combustion chamber is ionized by ionization electrodes energized with high voltage. The ionization in the combustion chamber makes possible an electrical flashover between two electrodes. The proposed plasma igniter has only ionization electrodes arranged on the outer enclosure of the plasma igniter. High pressure is generated in a plasma igniter, so that openings in the outer shell of the plasma igniter mean a risk of gas leakage or malfunction of the plasma igniter.

It is desirable to solve the above-identified problem. It is also desirable to provide an improved plasma generator for repeatable initiation of propellant charges in a weapons system, avoiding complicated arrangements for dispensing and supplying of liquids between electrodes.

It is also desirable to provide an improved plasma generator for repeatable initiation of propellant charges in a weapons system, where the length and ignition energy of the plasma generator can be adapted.

It is also desirable to provide an improved plasma generator for repeatable initiation of propellant charges in a weapons system, where the plasma generator lacks openings in the outer shell of the plasma igniter.

It is also desirable to provide an ammunition unit comprising said improved plasma generator.

It is also desirable to provide a launching device comprising said improved plasma generator.

The neutral filling gas may be composed of atmosphere gas or residual gas from a previous firing. The electrical discharge may consist of or comprise a surface flashover, a volume flashover, or a transition from a surface flashover from bound charges in the surface of the combustion chamber body to a volume flashover in the combustion chamber channel. The volume flashover in the combustion chamber channel and the following power development increases the gas pressure in the combustion chamber and energy is surrendered via recombination between free electrons and ions, as well as neutral particles, to photons which dissociate and ionize the filling gas as well as the surface of the combustion chamber body. This surface thereby releases gas to the combustion chamber channel, which further increases the pressure and supplies further neutral particles to the volume, having a braking effect on the impedance collapse which occurs in the combustion chamber channel and increases the share of the electrical power in the combustion chamber, where the impedance does not drop to zero as in gas discharges with an open geometry. The pressure and the temperature rise in the combustion chamber expel the ignition gas with plasma-like and electrically conductive characteristics from the passageway of the one terminal to reach the propellant being initiated.

Thus, according to the present invention an improved plasma generator has been created for initiation of propellant charges in a weapons system, for example when launching projectiles from a barrel weapon, by electrical discharge between a rear electrode and a front electrode in a combustion chamber channel enclosed in a combustion chamber body and filled with filling gas, designed to ignite at least one propellant charge, where the plasma generator comprises at least one ionization electrode situated inside the enclosing combustion chamber body, where ionization electrodes are connected to an initiation circuit comprising at least one first high-voltage generator, for ionization of the filling gas in the combustion chamber channel (3), and a second high-voltage generator designed for electrical discharge in the electrically conductive gas from the rear electrode via at least one ionization electrode onward to the front electrode so that hot ignition gas under high pressure is formed.

Having at least one ionization electrode situated inside the enclosing combustion chamber body means that ionization electrodes do not penetrate the combustion chamber body.

Ionization electrodes are entirely enclosed by the combustion chamber body. Ionization electrodes are not in physical contact with the combustion chamber body.

According to further aspects of the improved plasma generator of the invention:

the initiation circuit comprises the first high-voltage generator and at least one circuit breaker connected to the first terminal of at least one capacitor, wherein ionization electrodes are connected to the second terminal of said capacitor;

the initiation circuit comprises at least one inductance coil connected between the second terminal of the capacitor and the ionization electrodes;

the ionization electrodes are secured firmly on a conical holder, the ionization electrodes being in open contact with the combustion chamber channel and electrically connected to the initiation circuit. Open contact means that the ionization electrodes are exposed to the combustion chamber channel, that is, the ionization electrodes are not covered.

The ionization electrodes are designed with at least one flashover conductor at least at one point.

The ionization electrodes are arranged in circular symmetry around a center line and an electrical insulator is formed between the ionization electrodes by the conical holder, which is situated at the center of the rear electrode, the conical holder and the rear electrode being arranged such that electrical contact is possible between the initiation circuit and the ionization electrodes.

The rear electrode situated at the rear end of the combustion chamber channel is electrically connected to the second high-voltage generator and the front electrode situated at the front end of the combustion chamber channel is connected to ground, said rear and front electrode being made of an electrically conductive material, and a gas outlet is arranged in the front electrode, emerging at the propellant charge.

The gas outlet is one of a convergent nozzle or a divergent nozzle or a convergent-divergent nozzle.

Furthermore, according to the present invention an improved ammunition unit has been created, comprising a mortar tube, a projectile, a propellant charge and an ignition device, said ignition device being comprised of a plasma generator.

Furthermore, according to the present invention an improved launching device comprising a barrel, a propellant charge and an ignition device, said ignition device being comprised of a plasma generator, is provided.

BRIEF DESCRIPTION OF THE DRAWINGS

The invention shall be described more closely below, making reference to the enclosed figures, where.

DETAILED DESCRIPTION

Figure 1A:
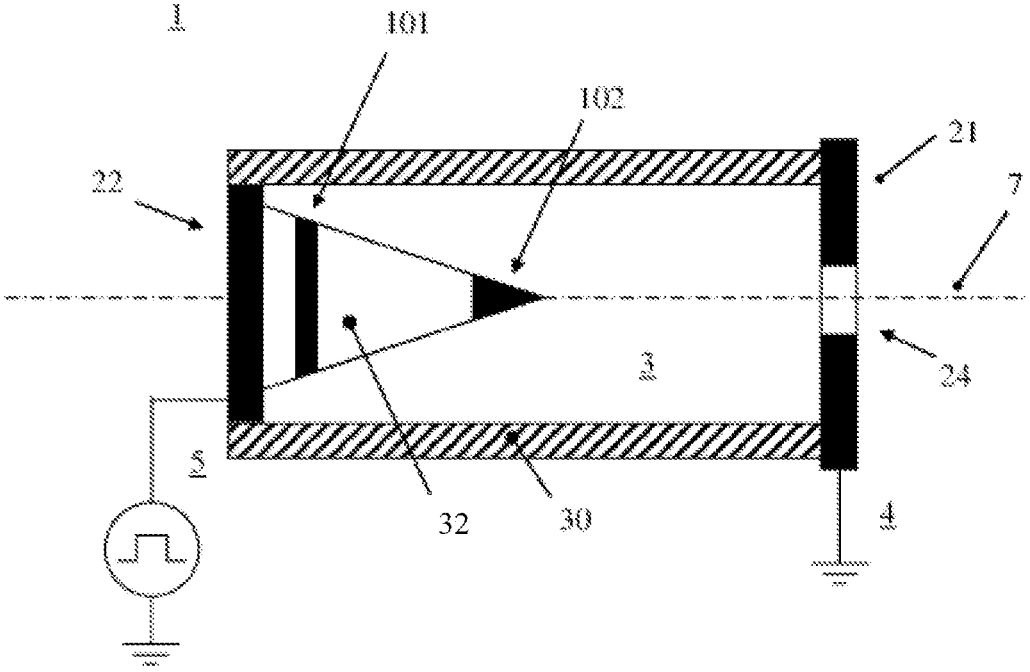
FIG. 1*a* shows schematically a longitudinal section through a repeatable plasma generator according to a first embodiment of the invention.

The plasma generator 1 shown in FIG. 1*a* comprises a front electrode 21, a combustion chamber body 30 having a combustion chamber channel 3, and a rear electrode 22. Moreover, the plasma generator 1 has a number of ionization electrodes 101 and 102, two in the figure and the embodiment. The ionization electrodes are connected to the initiation circuit 99, not shown in FIG. 1*a*.

The combustion chamber body 30, preferably tubular, is part of the plasma generator 1 and forms the combustion chamber channel 3 of the plasma generator. The combustion chamber body 30 is designed to withstand high pressure and has no passageways, holes, or other physical conformation which can weaken its strength. The combustion chamber channel 3 extends axially through the plasma generator between a front electrode 21 and a rear electrode 22. The front part of the combustion chamber channel 3, i.e., the gas outlet 24 of the plasma generator 1, is preferably configured as a nozzle mounted or directly worked into the front electrode 21. The front electrode 21 is connected to electrical ground 4. The rear electrode 22 is electrically connected to a high-voltage generator 5, also known as the second high-voltage generator, and mounted toward the combustion chamber body 30.

Figure 1B:
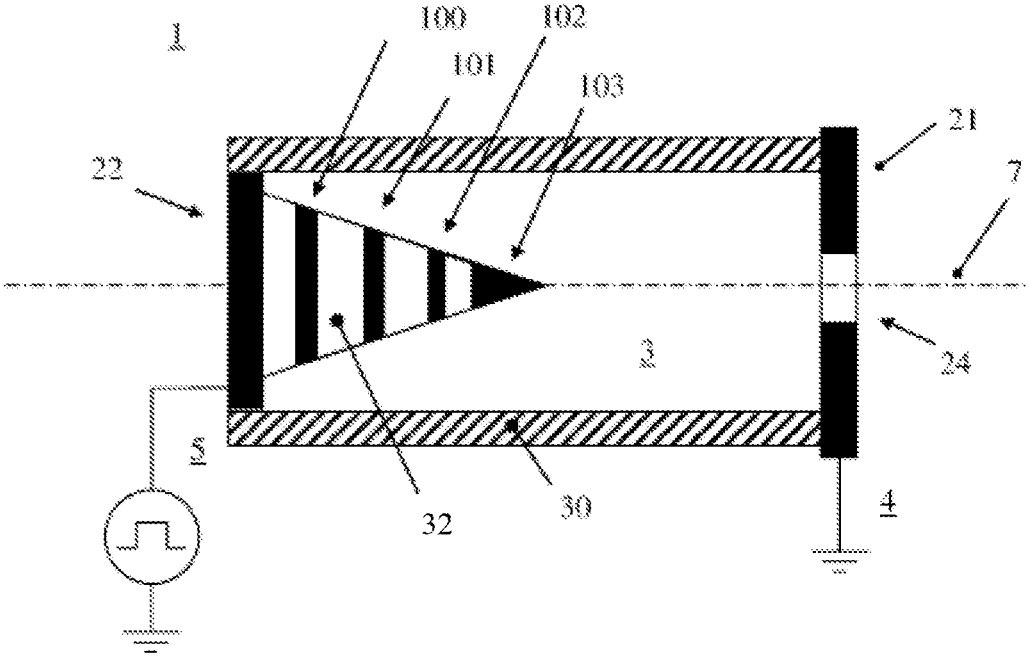
FIG. 1*b* shows schematically a longitudinal section through a repeatable plasma generator according to a second embodiment of the invention.

The plasma generator 1 shown in FIG. 1*b* comprises a front electrode 21, a combustion chamber body 30 having a combustion chamber channel 3, and a rear electrode 22. Moreover, the plasma generator 1 has a number of ionization electrodes 100, 101, 102 and 103, four in the figure and the embodiment. The ionization electrodes are connected to the initiation circuit 99, not shown in FIG. 1*b*.

One or more ionization electrodes 100, 101, 102 and 103 are arranged inside and not making contact with the combustion chamber body 30 inside the combustion chamber channel 3 and are connected to an outside initiation circuit 99 having an outside high-voltage generator 2, also called the first high-voltage generator. The ionization electrodes 100, 101, 102 and 103 are preferably arranged on a conically shaped holder 32, where the conical holder 32 is situated at the rear electrode 22. The conical holder 32 is preferably arranged in circular symmetry inside the combustion chamber body 30 and made of insulating material, and it may be composed of multiple parts making possible the positioning of the ionization electrodes.

The ionization electrodes 100, 101, 102 and 103 are preferably in circular symmetry and situated centrally inside the combustion chamber body 30 around the center line 7; moreover, the parts of the conical holder 32 which are situated between the ionization electrodes 100, 101, 102 and 103 are preferably in circular symmetry and arranged about the center line 7. Inside the conical holder 32, not shown in the figure, is an arrangement for electrical connecting of the ionization electrodes 100, 101, 102 and 103, situated for example by coaxially arranged coupling paths. The conical holder 32 may contain a sacrifice material, which is part of the ionization and/or the electrical flashover under electrical influence. Besides a conical shape, other shapes may be used where the radius of the circular symmetrical segment decreases from the rear electrode 22 forward in the lengthwise extension of the plasma generator.

Figure 2:
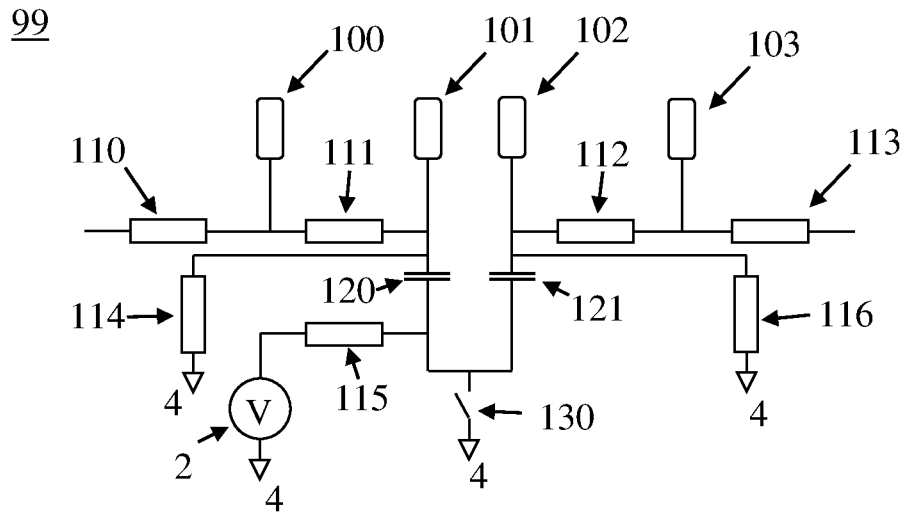
FIG. 2 shows a circuit diagram of the connection of the ionization electrodes according to one embodiment of the invention.

The electrical circuit diagram for the outside initiation circuit 99, in the case when four ionization electrodes are used, is described in FIG. 2. FIG. 2 shows how the ionization electrodes 100, 101, 102, 103 are connected to the initiation circuit 99. Two high-voltage capacitors, 120 and 121, are charged to high voltage by a high-voltage generator 2. The charging current is limited by a charging resistor 115. The charging resistor 115 also minimizes the discharge current to the high-voltage generator 2 from the capacitors 120 and 121. The connection node of the capacitors 120, 121 which is connected to the high-voltage generator 2, is charged to a high-voltage potential. The opposite side of the capacitors 120, 121, the side not connected to the high-voltage generator, is connected to ground 4 across current-limiting resistors 114, 116. The resistors 114, 116 are designed to produce a current limiting during the charging of the capacitors 120, 121 and to act as a current limiting of the current pulse passing through the ionization electrodes 100, 101, 102, 103 upon discharging of the capacitors 120, 121 and thus initiation of the plasma generator. Current-limiting electrode resistors 110, 111, 112, 113 are connected between the ionization electrodes 100, 101, 102, 103. In the case of using four ionization electrodes 100, 101, 102, 103, as shown in the figure, only two of the electrode resistors 111, 112 are needed. In the case of using two ionization electrodes, none of the electrode resistors 110, 111, 112, 113 are needed. The electrode resistors 110 and 113 shown in the figure are meant to exemplify how the connection can be increased for further coupling of a larger number of ionization electrodes than four. The number of ionization electrodes can be chosen freely based on the desired size of the plasma generator 1, the desired operating voltages, and the available and desirable energy levels. A circuit breaker 130, also known as a switch, can switch the high-voltage side of the capacitor to ground at a certain point in time. The circuit breaker 130 may be of the trigatron, spark gap, semiconductor or other type. The resistors 114 and 116 prevent the discharge current from the second high-voltage generator 5 being discharged through the ionization electrodes. The electrical discharge is designed to proceed from the rear electrode 22 to the front electrode 21 while the resistors 114 and 116 and the electrode resistors 110, 111, 112, 113 prevent the current from flowing to ground 4 through the initiation circuit 99.

Figure 3:
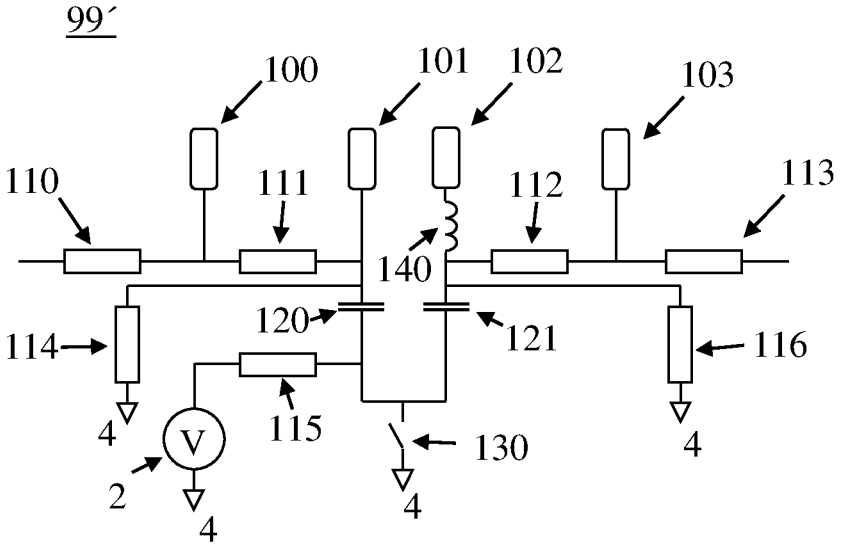
FIG. 3 shows an alternative circuit diagram of the connection of the ionization electrodes according to one embodiment of the invention.

FIG. 3 shows an alternative circuit diagram for the outside initiation circuit 99' through a connecting of the ionization electrodes 100, 101, 102, 103. A certain inductance, also called stray inductances, occurs in all electrical circuits, where the inductances in the circuit affect how the electrical signals are propagated in the circuit. By inserting inductances 140 in the circuit from the ionization electrodes located at further distance from the rear electrode 22, the electrical flashover in the combustion chamber channel 3 can be controlled. The introduced inductances 140 are preferably larger than the stray inductances occurring in the circuit.

Figure 4:
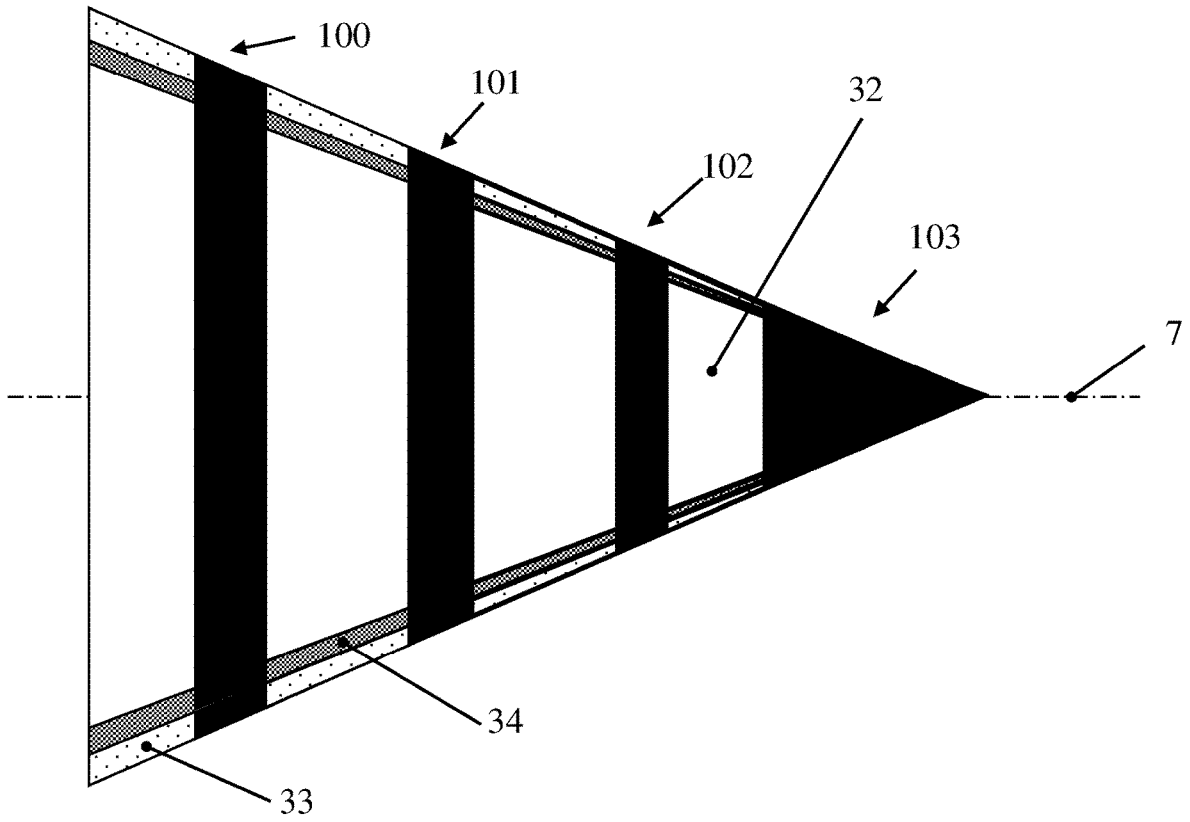
FIG. 4 shows an enlarged detail of the conical holder of FIG. 1*b* according to one embodiment of the invention.

The conical holder 32 of FIG. 4 is configured in one embodiment to be consumed layer by layer through successive burning of the two material layers 33 and 34 shown in FIG. 4. Additional material layers may be present, of course. A layer is consumed in each initiation, each new energy pulse at the surface of the conical holder 32 exposed in the combustion chamber channel 3 gasifying the surface entirely or partially and generating a plasma created by the electrical discharge between the rear electrode 22 and the front electrode 21. The first pulse gasifies the material layer 33, thereby exposing the material layer 34 to the combustion chamber channel 3. After this comes the next pulse, gasifying the next layer 34, and so forth. The gasification may occur layer by layer in either the axial or the radial direction, but may also occur through an increased consumption of material around the ionization electrodes 100, 101, 102, 103 and decreasing toward the front electrode 21 and the rear electrode 22. Other consumption patterns are also possible. The fully or partially consumed conical holder 32 can be easily replaced with a new one as needed.

The conical holder 32 may be formed, e.g., by a lamination technique, where a particular number of layers are assembled, corresponding to the number of ignition pulses which the plasma generator 1 is dimensioned to generate. The conical holder 32 may also be made from a homogeneous material or a homogeneous material in combination with lamination, or by sintering, pressing, or another joining technique which is suitable for joining of metallic and polymer material where the portion of metallic material is on the order of 10-50 wt. % and the portion of polymer material is on the order of 50-90 wt. %. A variation of the amount of energy supplied to the plasma generator may also be utilized to gasify one or more layers in a laminated conical holder 32 or a varying mass in the conical holder 32 made from a homogeneous material.

The filling gas in the combustion chamber channel 3 is ionized with the ionization electrodes 100, 101, 102 and 103, which increases the conductivity and enables the very powerful electrical pulse initiated with a given time duration, amplitude and shape between the front electrode 21 and rear electrode 22, which causes the surface layer to be heated, gasified, and ionized entirely or partially, layer by layer, into plasma, hot gas and hot particles, whereupon a predetermined plasma is made to flow out through the end muzzle opening 24 with a very high pressure and a very high temperature and with a large quantity of gas and hot particles.

The conical holder 32 preferably comprises at least one sacrifice material or outer layer which falls apart in the resulting plasma into molecules, atoms or ions. Such a sacrifice material or outer layer advisedly contains hydrogen and carbon, for example. For the generating of hot particles, metallic material in combination with hydrogen and carbon, for example, can also be part of the conical holder 32. The conical holder 32 in the described embodiment is enclosed by at least one dielectric polymer material, preferably a plastic with high melting temperature (preferably over 150° C.), high gasification temperature (over 550° C., preferably over 800° C.) and low thermal conductivity (preferably below 0.3 W/mK). Especially suitable plastics include thermoplastics or thermosetting plastics, such as polyethylene, fluoroplastic (such as polytetrafluorethylene, etc.), polypropylene etc., or polyester, epoxy or polyimides, etc., to ensure that only one outer layer 33, 34 of the conical holder is gasified for each energy pulse.

The sacrifice material in the conical holder 32 should also preferably be sublimating, i.e., pass directly from the solid to the gas form. It is also conceivable to arrange different layers of material, thickness, etc., to form a laminated conical holder 32 to bring about said layered 33, 34 gasification of the laminate in the conical holder 32, or to combine metallic and/or polymer material by sintering, pressing, or other joining technique into a conical holder 32 to bring about said layered 33, 34 gasification of the laminate in the conical holder 32.

The outer surface of the conical holder 32 is designed, dimensioned, and manufactured such that only the outermost surface of the conical holder 32, i.e., the portion exposed from the combustion chamber channel 3, the free outer layer 33, 34 between the front electrode 22 and the rear electrode 21, is gasified during each electrical pulse. Optimally, the conical holder 32 will be consumed during the last conceivable plasma generation for the plasma generator 1.

Since the consumption of the conical holder 32 may be thought of as being dynamically variable between each use, depending on the configuration of the propellant, the projectile, the ambient temperature or the nature of the target, for example, the conical holder is manufactured with a certain margin so that it can function within the conceivable embodiments of the application.

The conical holder 32 may also be made for example of a ceramic, a semiconductor ceramic, or another material such as a plastic or other substance not consumed upon initiation of the plasma generator 1. Upon initiation of a plasma generator 1 with a nonconsumable conical holder 32, the filling gas contained in the combustion chamber channel 3 is ionized by the electrical discharge. After an electrical discharge, the conical holder 32 may be coated with an outer layer of soot, for example, which thereafter becomes part of the process. An entirely new conical holder, not yet exposed to an electrical discharge, may be coated with an outer layer, for example one of grease, soot, or the like, which is ionized by the ionization electrodes to initiate a first electrical discharge between the rear and front electrode. With a conical holder 32 made of a nonconsumable material, the conical holder 32 does not need to be replaced during repeated use.

Figure 5:
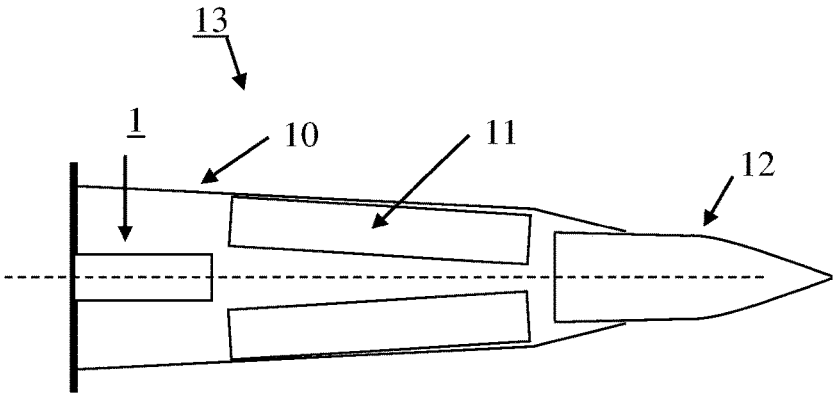
FIG. 5 shows schematically a section through an ammunition unit comprising a plasma generator according to one embodiment of the invention.

FIG. 5 shows a tube-equipped ammunition unit 13 with integrated plasma generator. The plasma generator 1 is mounted in a cartridge tube 10, together with a propellant charge 11 and a projectile 12. The propellant charge 11 can be, for example, a solid powder containing at least one charging unit in the form of one or more cylindrical rods, disks, blocks, etc. The charging units are multiperforated with a large number of burn channels so that a so-called multi-hole powder is produced. Alternative configurations of the propellant charge 11 are possible, of course.

Figure 6:
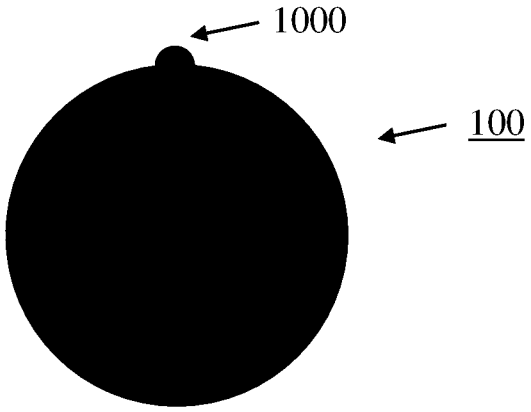

FIG. 6 shows an ionization electrode 100 designed with a flashover conductor 1000. The flashover conductor 1000 is designed to control the electrical flashover so that the electrical flashover moves between the flashover conductors situated on the respective ionization electrode. The flashover conductor is arranged as a piece projecting from the ionization electrodes, preferably sticking out from the conical holder 32.

The function and application of the plasma generator 1 according to the invention is as follows in the case when four ionization electrodes are used.

During the firing and initiation of the plasma generator 1, the capacitors 120, 121 charged by the high-voltage generator 2 are made to discharge by the circuit breaker 130. The capacitors 120, 121 are connected to the ionization electrodes 100, 101, 102, 103, and the charge redistribution upon discharging of the capacitors brings about an ionization of the filling gas in the combustion chamber channel 3. When the degree of ionization is such that plasma generation can be initiated, the second high-voltage generator 5 is made to produce a powerful electrical energy pulse, having a high current strength and/or a high voltage, both with a particular determined amplitude and pulse length adapted to the properties of the particular weapon, the temperature, the propellant charge, the projectile, the target, the surroundings, etc. The impedance of the plasma generator 1 is low in the active state, i.e., during the plasma generation, so that preferably a high current is generated from the second high-voltage generator 5, on the order of 10 to 100 kA, but in order to have a successful flashover a high voltage is needed, on the order of 1 to 10 kV. To produce an effective plasma, for flashover of the propellant bed, each energy pulse should exceed 1 kJ, but it may be as much as 30 kJ, and is supplied to the plasma with a pulse length between 1 and 10 ms.

The design with multiple successive ionization electrodes 100, 101, 102 and 103 in the combustion chamber channel 3 causes the electrical flashover between the rear electrode 22 and the front electrode 24 to move step by step between the ionization electrodes. During the first flashover or discharge from the rear electrode 22 to the first ionization electrode 100, UV light from the discharge ionizes the filling gas. The electrical field then moves from the rear electrode 22 to the first ionization electrode 100, facilitating the next discharge from the ionization electrode 100 to the ionization electrode 101. UV light is also produced during the discharge between the ionization electrodes 100 and 101 for further ionization and a further movement of the electrical field. In the same way, the electrical flashover occurs onward to the front electrode 21. A very limited current will flow to ground in the ionization electrodes, since the resistance to ground is high. Most of the electrical energy in the high-voltage generator 5 will be discharged from the rear electrode 22 to the front electrode 21 and to the filling gas in the combustion chamber channel 3. The resistors have a resistance on the order of 1 to 100 kOhm in order to limit the portion of the current flowing from the high-voltage generator 5 to ground via the ionization electrodes 100, 101, 102, 103. When the initiation of the plasma generator 1 occurs by the closing of the circuit breaker 130, a charged voltage in the capacitors 120 and 121 is discharged partly across the circuit breaker 130 to ground, at the same time that a charge redistribution occurs from the ionization electrodes 100, 101, 102 and 103 and the capacitors 120 and 121. The charge redistribution from the ionization electrode 100 occurs through the resistor 111 and the charge redistribution from the ionization electrode 103 occurs through the resistor 112.

The powerful electrical energy pulse generates an electrical flashover, also called an arc discharge, between the rear electrode 22 and the front electrode 21, via the ionization electrodes 100, 101, 102, 103, and in the plasma channel created by the arc discharge the temperature becomes so high that the outermost layer of the conical holder 32 is melted, gasified, and finally ionized to form a very hot plasma. In one alternative embodiment, a substance supplied to the combustion chamber channel 3 can be part of the substance forming a plasma in connection with the arc discharge. It may also be the case that only the filling gas is ionized; in this case, none of the conical holder 32 is consumed. Moreover, it may be the case that an outer coating on the conical holder 32 is ionized and creates a plasma channel so that an arc discharge occurs between the rear electrode 22 and the front electrode 21; in this case, none of the conical holder 32 is consumed. Due to the high pressure generated by the gasification in the combustion chamber channel 3, the generated plasma-like gas is caused to spurt out through the gas outlet 24, which gas outlet 24 is shaped like a nozzle. The pulse length, pulse shape, current strength and voltage can be varied according to the current conditions of the firing situation, such as the surrounding temperature, the humidity, etc., and the special properties of the particular weapons system and ammunition or projectile type, as well as the current target type, including the range to that target.

A plasma generator with variable ignition energy enables an instantaneous flashover of the entire propellant charge and thereby makes possible an immediate pressure rise. A plasma generator also has the advantage that the ignition energy can be varied over time, unlike a pyrotechnical igniter. Variable ignition energy means that the ignition energy can be adapted to different types and sizes of propellant charges, so as to vary the firing range of the projectile, and also to compensate for the temperature dependence of the propellant charge. The quantum of energy with which the high-voltage generator 5 is charged is adapted according to the size and performance of the plasma generator 1. Since the impedance in the electrical flashover between the rear electrode 22, via the ionization electrodes 100, 101, 102, 103, to the front electrode 21 approaches zero, electrical energy is no longer supplied to the plasma channel. Since no energy is supplied to the plasma channel, the pulse from the high-voltage generator 5 can be interrupted or terminated. Preferably, the quantum of energy in the high-voltage generator 5 is thus adapted so that the impedance in the electrical flashover approaches zero when the high-voltage generator 5 is discharged. In this way, the plasma generator 1 is optimized in terms of energy.

Weapons systems can be ignited more easily and safely with the proposed repeatable plasma generator. The avoidance of vulnerable ignition substances and ignition cartridges means that complete use of propellants with low vulnerability can be adopted. Problems with difficult mechanisms such as one for changing of ignition cartridges or dispensing equipment for liquids can be avoided. The technique provides increased control over the parameters of the ignition pulse, such as energy content, pulse length, and ignition time. The ignition pulse can be adapted to the size of the propellant charge depending on the quantity of propellant, the sensitivity of the propellant, and the ambient temperature.

The example of a plasma generator according to the invention, intended for use in an artillery system as replacement for a conventional ignition cartridge, utilized energy pulses of around 1 to 10 kJ with duration of several milliseconds and voltage in the range of 5 to 20 kV. Current strength in the range of 1 to 50 kA. Distance between front electrode 21 and rear electrode 22 was on the order of 20 to 100 mm.

The invention is not limited to the configurations shown especially, but instead can be varied in different ways within the claims.

It is evident, for example, that the number, size, material and shape of the elements and parts making up the ammunition unit and the plasma generator can be adapted according to the weapons system or systems and other design properties in the particular instance.

It is evident that the above-described ammunition embodiment may comprise many different dimensions and projectile types, depending on the area of application and the barrel width. However, the most commonly occurring projectiles today, between around 20 mm and 160 mm, are considered above.

In the embodiments described above, the plasma generator comprises only one front gas outlet, but it also comes under the notion of the invention to arrange several nozzle openings along the surface of the combustion chamber channel or several openings in the front opening 24.

The plasma generator is repeatable but it may also be used in a onetime configuration, for example, in an ammunition application, an igniter for a warhead or for initiation of rocket motors.

The invention claimed is:

1. A plasma generator for initiation of propellant charges in a weapons system by electrical discharge between a rear electrode and a front electrode in a combustion chamber channel enclosed in a combustion chamber body and filled with filling gas, designed to ignite at least one propellant charge, wherein the plasma generator comprises at least one ionization electrode situated inside the enclosing combustion chamber body, not in physical contact with the combustion chamber body, where ionization electrodes are connected to an initiation circuit, comprising at least one first high-voltage generator, for ionization of the filling gas in the combustion chamber channel, and a second high-voltage generator designed for electrical discharge in the electrically conductive gas from the rear electrode via the at least one ionization electrode onward to the front electrode so that hot ignition gas under high pressure is formed.

2. The plasma generator according to claim 1, wherein the initiation circuit comprises a first high-voltage generator and at least one circuit breaker connected to the first terminal of at least one capacitor, wherein ionization electrodes are connected to the second terminal of the capacitor.

3. The plasma generator according to claim 2, wherein the initiation circuit comprises at least one inductance coil connected between the second terminal of the capacitor and the ionization electrodes.

4. The plasma generator according to claim 1, wherein the ionization electrodes are secured firmly on a conical holder, the ionization electrodes being in open contact with the combustion chamber channel and electrically connected to the initiation circuit.

5. The plasma generator according to claim 4, wherein the ionization electrodes are arranged in circular symmetry around a center line and an electrical insulator is formed between the ionization electrodes by the conical holder, which is situated at the center of the rear electrode, the conical holder and the rear electrode being arranged such that electrical contact is possible between the initiation circuit and the ionization electrodes.

6. The plasma generator according to claim 1, wherein the ionization electrodes are designed with at least one flashover conductor at least at one point.

7. The plasma generator according to claim 1, wherein the rear electrode situated at the rear end of the combustion chamber channel is electrically connected to the second high-voltage generator and the front electrode situated at the front end of the combustion chamber channel is connected to ground, the rear and front electrode being made of an electrically conductive material, and a gas outlet is arranged in the front electrode, emerging at the propellant charge.

8. The plasma generator according to claim 7, wherein the gas outlet is one of a convergent nozzle or a divergent nozzle or a convergent-divergent nozzle.

9. An ammunition unit comprising a mortar tube, a projectile, a propellant charge and an ignition device, wherein the ignition device comprises the plasma generator according to claim 1.

10. A launching device comprising a barrel, a propellant charge and an ignition device, wherein the ignition device comprises the plasma generator according to claim 1.

* * * * *